US006282864B1

(12) United States Patent
Jänen

(10) Patent No.: US 6,282,864 B1
(45) **Date of Patent: *Sep. 4, 2001**

(54) OVERHEAD BOOM ARRANGEMENT FOR A PACKAGING MACHINE

(75) Inventor: Johannes Jänen, Troisdorf (DE)

(73) Assignee: Riverwood International Corporation, Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/319,375

(22) PCT Filed: Dec. 1, 1997

(86) PCT No.: PCT/GB97/03308

§ 371 Date: Jul. 23, 1999

§ 102(e) Date: Jul. 23, 1999

(87) PCT Pub. No.: WO98/24692

PCT Pub. Date: Jun. 11, 1998

(30) Foreign Application Priority Data

Dec. 5, 1996 (GB) ..... 9625294

(51) Int. Cl.[7] ..... B65B 21/24; B65G 15/12

(52) U.S. Cl. ..... 53/48.8; 53/48.1; 53/48.7; 53/209; 198/626.6; 198/836.2

(58) Field of Search ..... 53/48.1, 48.7, 53/48.8, 48.9, 209; 198/836.2, 626.5, 626.6

(56) References Cited

U.S. PATENT DOCUMENTS

| | | | | |
|---|---|---|---|---|
| 2,709,009 | * | 5/1955 | Frank et al. | 203/227 |
| 2,900,772 | * | 8/1959 | Chidsey, Jr. et al. | 53/48 |
| 2,996,169 | | 8/1961 | Gentry | 198/162 |
| 3,415,033 | * | 12/1968 | Perry et al. | 53/32 |
| 3,430,412 | * | 3/1969 | Currie, Jr. | 53/48 |
| 3,509,684 | * | 5/1970 | Hohl et al. | 53/48 |
| 3,766,704 | | 10/1973 | Ganz | 53/48 |
| 3,826,060 | * | 7/1974 | Vergobbi | 53/48 |
| 3,915,290 | * | 10/1975 | Zuercher et al. | 198/162 |
| 3,940,907 | * | 3/1976 | Ganz | 53/48 |
| 3,977,150 | * | 8/1976 | Culpepper | 53/3 |
| 4,708,332 | * | 11/1987 | Besemann | 270/39 |
| 5,094,443 | * | 3/1992 | Young, Jr. | 271/245 |
| 5,221,177 | * | 6/1993 | Messerly et al. | 414/788.9 |
| 5,397,120 | * | 3/1995 | Schulz et al. | 271/198 |
| 5,458,033 | * | 10/1995 | Wiershke | 83/104 |
| 5,480,347 | * | 1/1996 | Hicks | 452/170 |
| 5,579,625 | * | 12/1996 | Olson et al. | 53/48.1 |
| 5,671,587 | * | 9/1997 | Robinson | 53/398 |
| 6,094,888 | * | 8/2000 | Pazdernik et al. | 53/436 |

FOREIGN PATENT DOCUMENTS

| | | | |
|---|---|---|---|
| 797148 | 6/1958 | (GB) . | |
| WO 96/32324 | 10/1996 | (WO) | B65B/21/24 |

* cited by examiner

*Primary Examiner*—Peter Vo
*Assistant Examiner*—Christopher Harmon
(74) *Attorney, Agent, or Firm*—Womble Carlyle Sandridge & Rice

(57) ABSTRACT

There is provided for a packaging machine an overhead boom arrangement 20 having a number of endless belts 22, 23 driven around sets of rollers 25. The belts 22, 23 contact the tops of articles/bottles 11 or carton blanks 50 and are driven at the same speed as the speed of the articles through the packaging machine. At least one of the belts 23 is height adjustable relative to the other belt or belts 22. The boom arrangement holds the articles 11 whilst the blanks 50 are being folded around.

18 Claims, 5 Drawing Sheets

OVERHEAD BOOM ARRANGEMENT FOR A PACKAGING MACHINE

FIELD OF THE INVENTION

Figure 1:
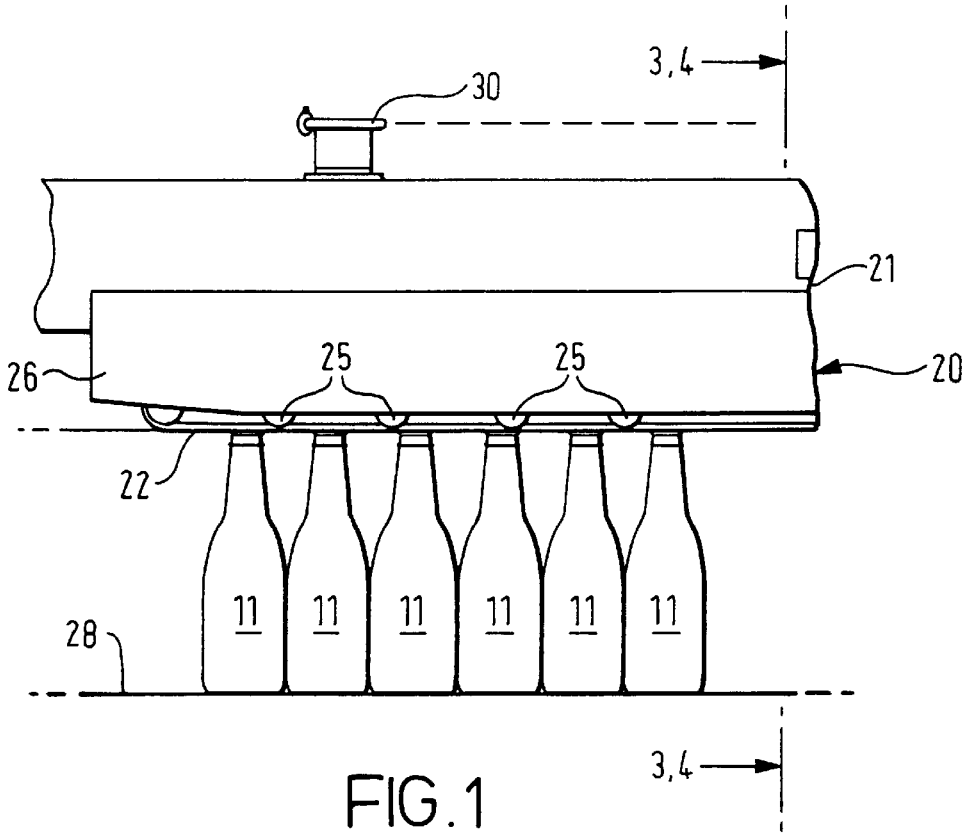

The present invention relates to an overhead boom arrangement for use in a packaging machine, particularly but not exclusively packaging machines for forming cartons around a plurality of products such as bottles or cans.

SUMMARY OF THE INVENTION

According to the present arrangement there is provided an overhead boom arrangement for use in a packaging machine comprising a support structure, a plurality of endless belts carried thereon, each endless belt being driven around a set of rollers mounted on the support structure and having an active portion of its path during which in use the belt engages blanks or products as they move through the packaging machine, at least one of the belts being height adjustable such that said active portion of said one belt path is movable upwards and downwards relative to the support structure and the active portions are parallel to each other and in use run at the same speed equal to that of the product speed of the packaging machine.

In some preferred arrangements three belts are provided, the central belt being height adjustable relative to the support structure of the boom arrangement and the outer two belts being fixed relative to the support structure.

In other preferred arrangements five belts are provided, the central and extreme side belts being fixed relative to the support structure and the two belts between the central belt and the respective extreme side belts being height adjustable relative to the support structure.

Preferably, in use, the complete overhead boom arrangement is movable vertically relative to the horizontal plain of the packaging machine. Conveniently the belts are elastic in nature and also the belts are circular in cross-section.

A preferred feature of the present invention is that each belt is supported by rollers along said active portion of the path of the belt. The rollers for the or each movable belt are carried by a bracket which is vertically movable relative to the support structure of the boom arrangement.

In certain embodiments said movement of the or each bracket is effected by a hand operated wheel attached to a sleeve carrying a threaded collar and mounted for rotation only relative to the support structure and a threaded shaft which cooperates with the threaded collar and which carries the bracket. With certain arrangements the threaded shaft is capable only of movement along its lengthwise axis.

One further preferred feature is that the rollers supporting each endless belt along said active portions are provided with resilient suspension means in a direction perpendicular to the active portions. Conveniently the rollers are mounted on rubber mountings.

A BRIEF DISCUSSION OF THE DRAWINGS

Another preferred feature is that the positions of the fixed

Another preferred feature is that the positions of the fixed and/or height adjustable endless belts are laterally adjustable.

Figure 2:
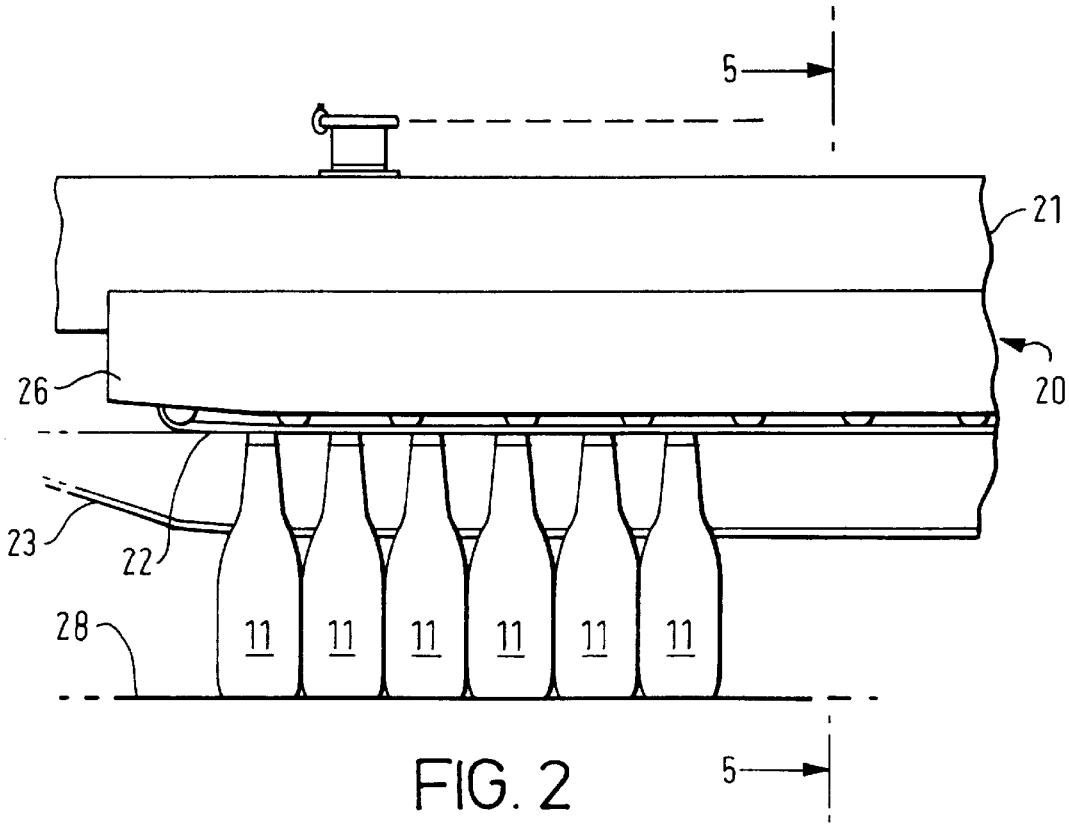
Figure 3:
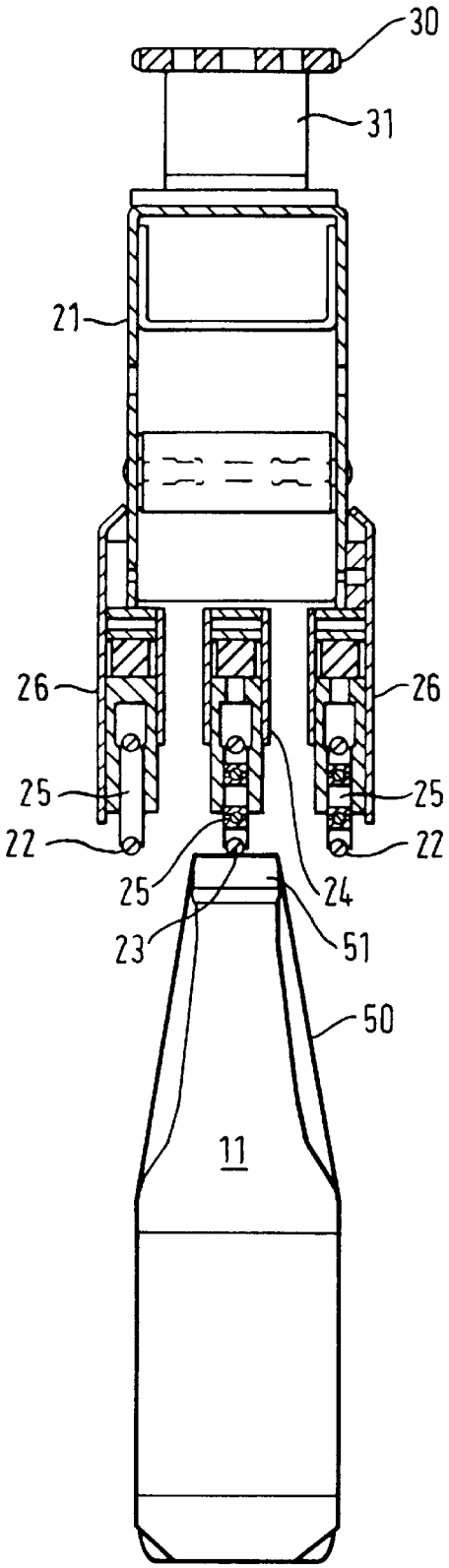
Figure 4:
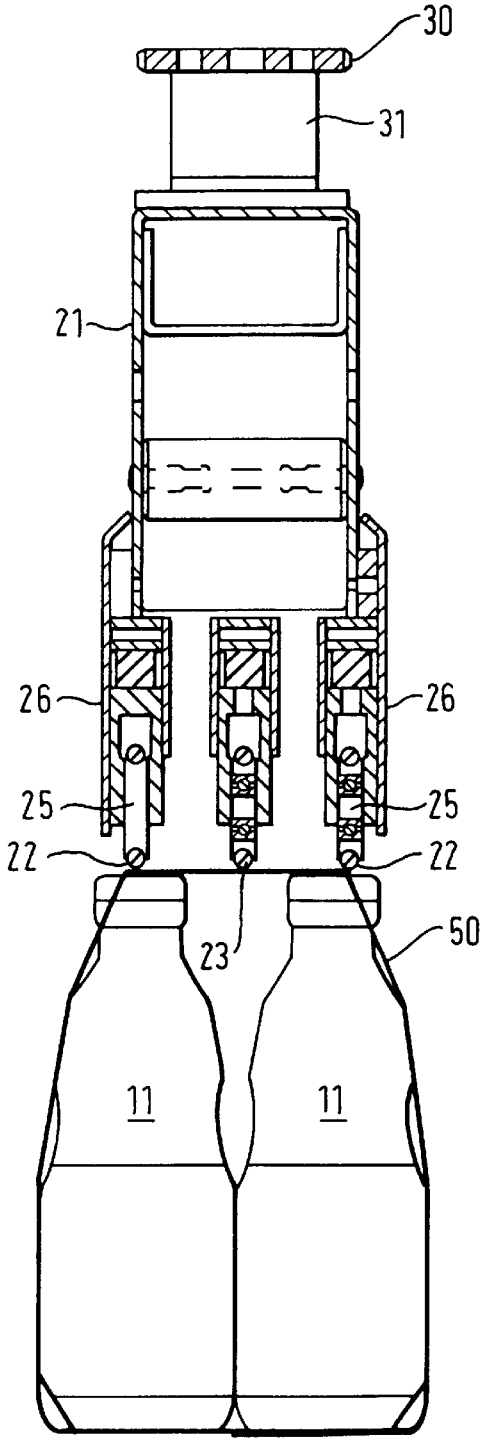
Figure 5:
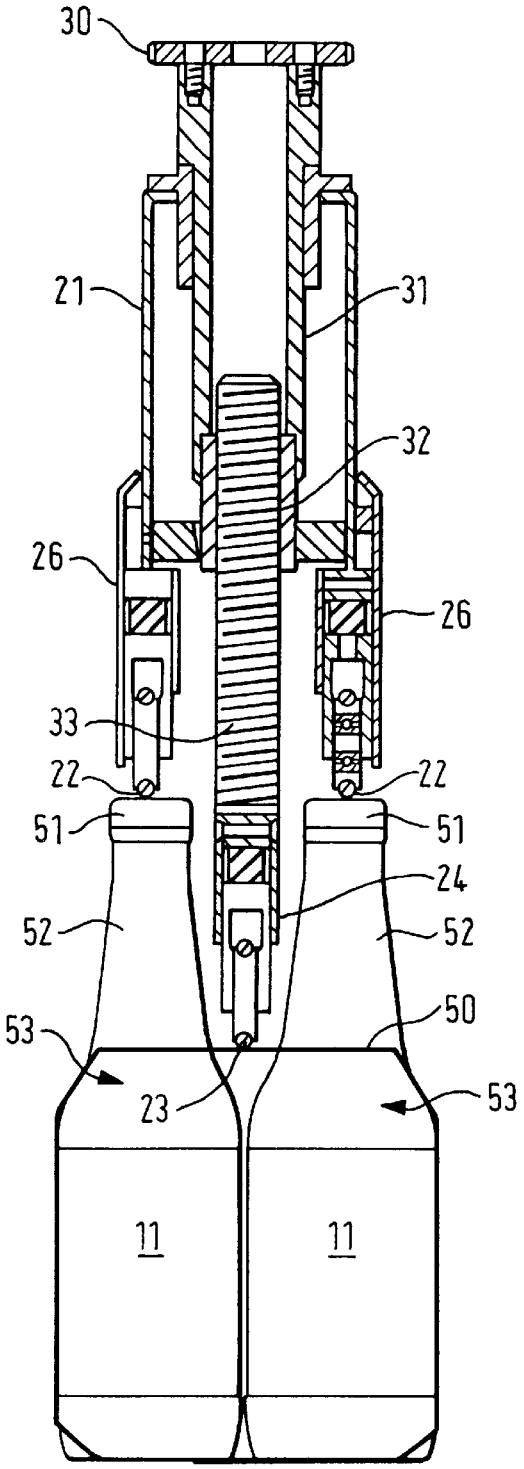
Figure 10:
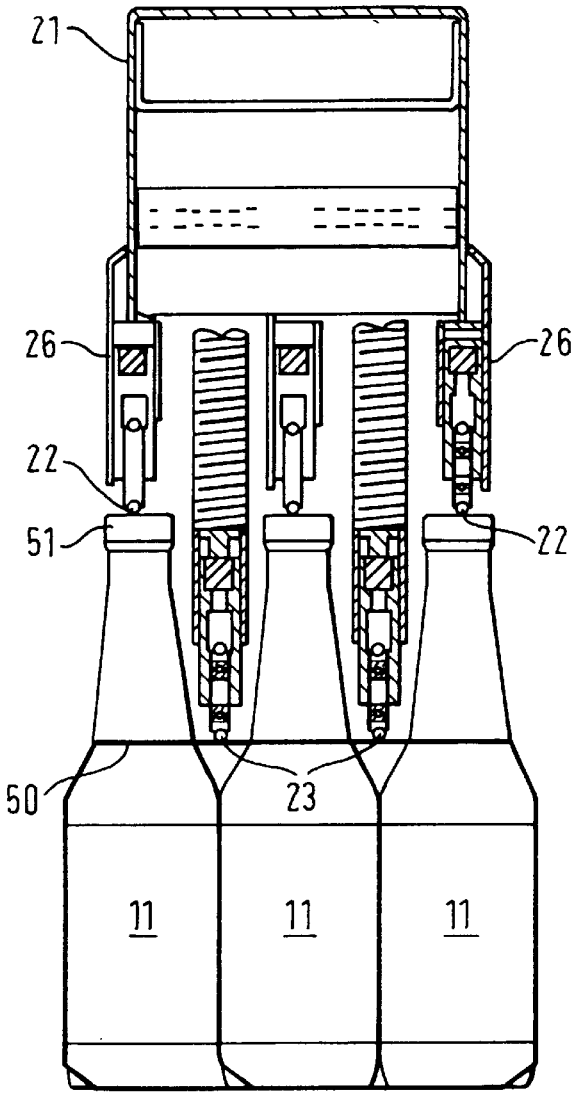
Figure 6:
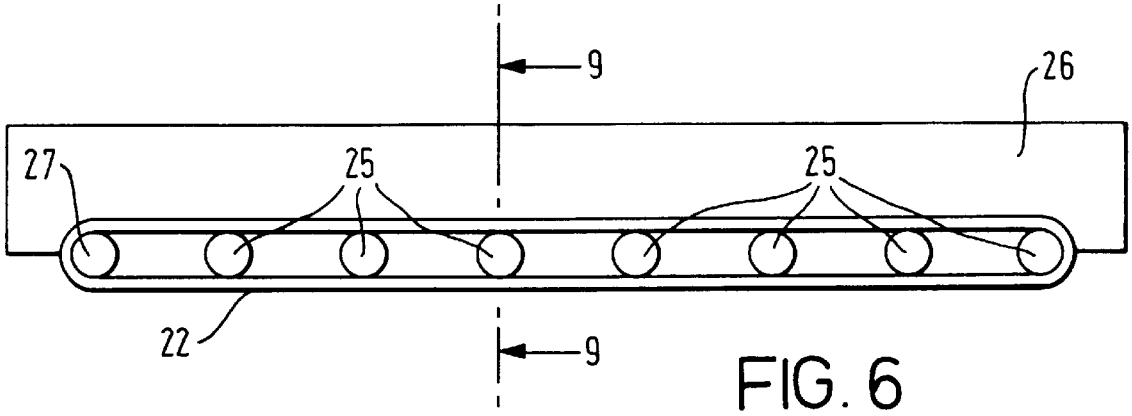
Figure 7:
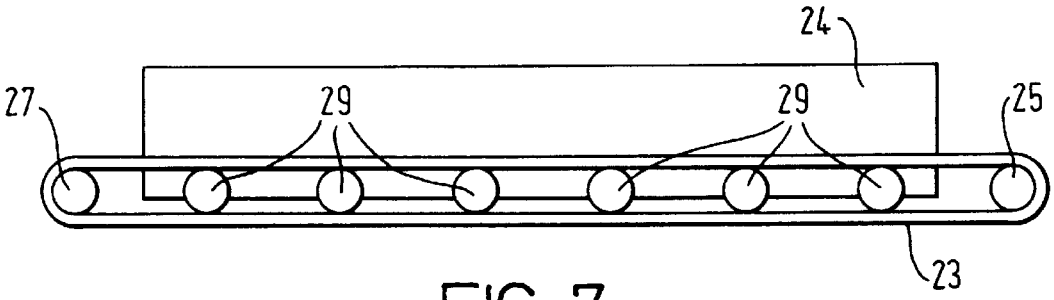
Figure 8:
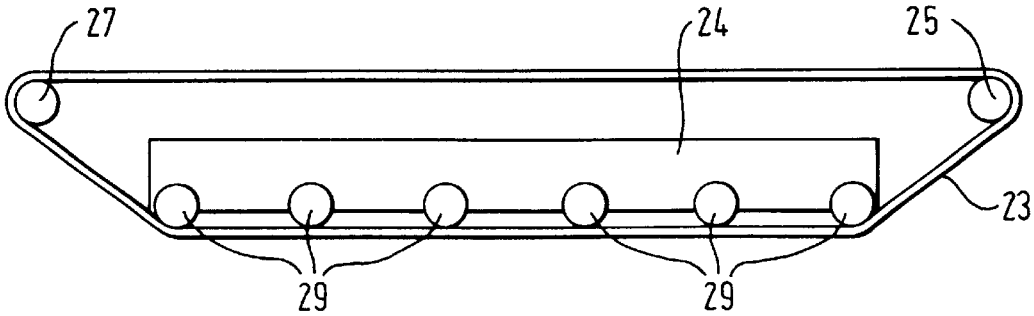
Figure 11:
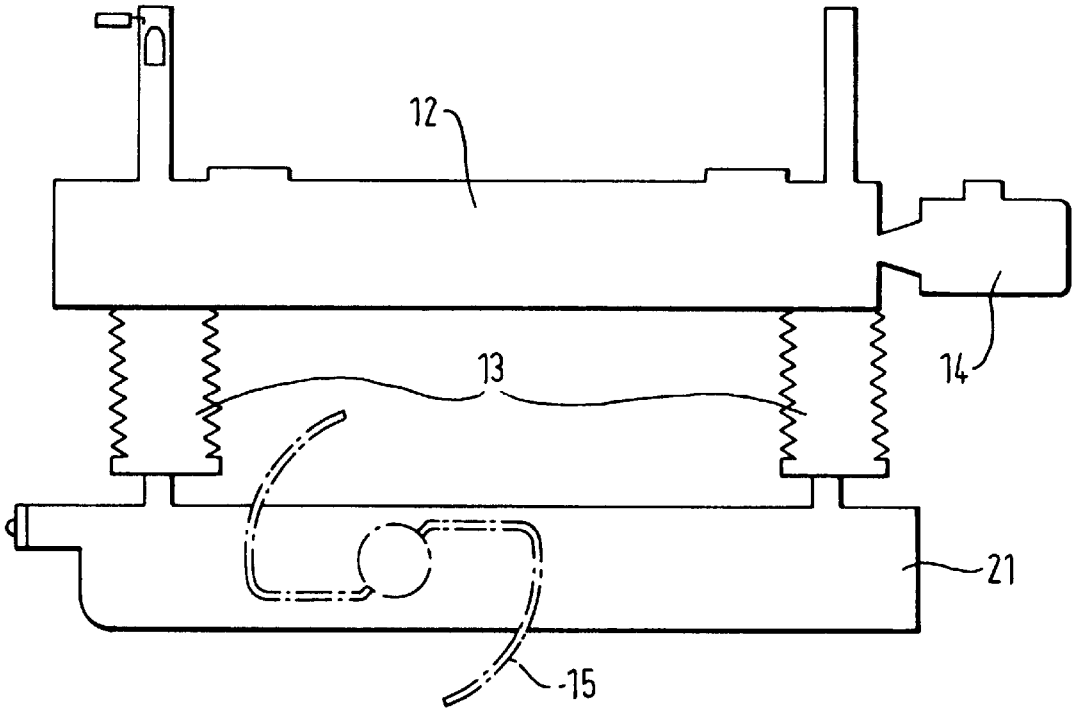
Figure 9:
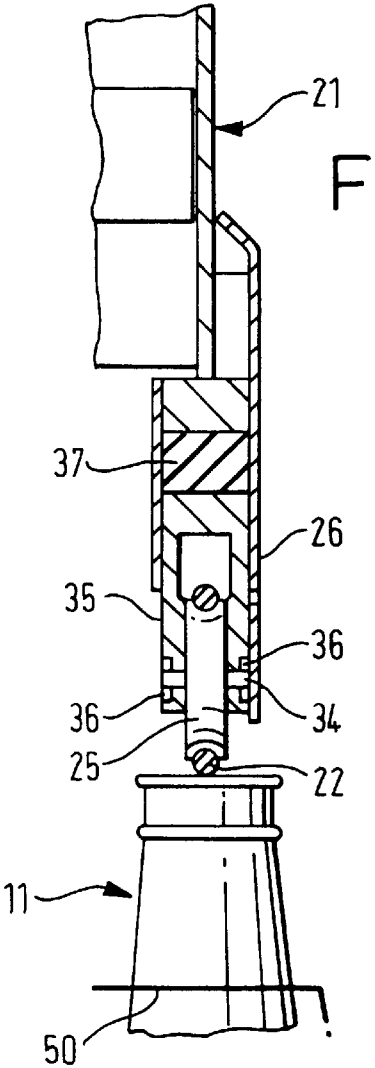

Embodiments of the present invention will now be described in more detail. The description makes reference to the accompanying drawings in which:

FIG. 1 is a side view of part of an overhead boom arrangement according to the present invention, FIG. 2 is a side view of part of the overhead boom shown in FIG. 1 in a different configuration, FIG. 3 is a sectional view taken on line 3—3 of the FIG. 1 arrangement operating on one type of product in single lane configuration, FIG. 4 is a sectional view taken on line 4—4 of the FIG. 1 arrangement operating on another type of product in twin lane configuration, FIG. 5 is a sectional view taken on line 5—5 of the FIG. 2 arrangement, FIG. 6 is a detailed view of a fixed belt section of the overhead boom of FIGS. 1 and 2, FIG. 7 is a detailed view of a movable belt section of the overhead boom of FIG. 1 showing the belt in an upper position, FIG. 8 is a detailed view of a movable belt section of the overhead boom of FIG. 2 showing the belt in a lower position, FIG. 9 is a detailed sectional view taken on line 9—9 of FIG. 6, FIG. 10 is a sectional view through a further embodiment of overhead boom, and FIG. 11 is a schematic side view of the overhead boom arrangement and its mounting.

A DETAILED DESCRIPTION

In FIGS. 1 and 2 there is shown part of a carton folding section 10 of a packaging machine for forming multipacks of bottles 11 in this embodiment. Other articles could of course be packed instead of the bottles 11. The bottles 11 are transported through the packaging machine at a steady machine speed whilst carton blanks 50 are transported from a blank magazine and on to the bottles. Further actions will fold the blanks and tighten and connect base panels of the carton beneath the bottles 11, but these areas are not shown.

In the embodiments illustrated, the bottles and/or the carton are engaged by an overhead boom arrangement 20 comprising a lengthwise extending support structure 21. The structure 21 carries two fixed endless belts 22 which are spaced apart in the transverse direction of the packaging machine and which extend in a lengthwise direction. Between the two fixed belts 22 the structure 21 carries an endless belt 23 which is movable in the upwards and downwards direction. This belt 23 is movable by virtue of being partially carried by a bracket 24 which is movable relative to the support structure 21.

The fixed belts 22 and the movable belts 23 have a round cross-section and are made from an elastic material such as rubber or synthetic rubber to allow for adjustment of the movable belts. The fixed belts 22 are stretched around a series of support rollers 25 which are secured for free rotation to panels 26 of the support structure 21 and also around end driven rollers 27 which are driven at machine speed. Each belt 22 is therefore driven at machine speed in the same direction as the bottles 11 during the active portion of its travel, namely when it is below the rollers 25, 27.

The movable belt 23 is stretched around a fixed roller 25 and a driven roller 27, similar to those described above in relation to the fixed belts, which rollers 25, 27 are fixed relative to the support structure 21. The belt also passes around a number of movable rollers 29 which are secured for free rotation on the bracket 24 disposed between the rollers 25, 27 for the movable belt. The bracket 24 is movable upwards and downwards relative to the support structure 21 and therefore relative to the fixed belts 22. This is clearly seen in FIGS. 5, 7 and 8.

The support structure 21 as a whole is movable relative to the conveyor 28, as can be seen from FIG. 11. The structure 21 is secured to the machine frame 12 by two adjustable supports 13 which can be lowered or raised by electric/servo motor 14 or hand wheels or other suitable means. This figure also shows rotating arms 15 for folding the sides of the blanks 50.

In order to enable the bracket 24 to move relative to the support structure 21 there is provided a hand operated wheel 30 attached to a sleeve 31 which extends into the support structure 21 and which is rotatable relative thereto about its lengthwise axis. At the base of the sleeve 31 is an internally threaded collar 32 which cooperates with a threaded shaft 33 attached to the bracket 24. It will be clear, therefore, that rotation of the hand operated wheel 30 results in upward or downward movement of the bracket 24 and, therefore, the movable belt 23. It will be readily appreciated that other ways of moving the bracket 24 are possible, the above arrangement being a preferred example.

FIG. 9 shows in more detail the mounting of the rollers 25 on the panels 26 of the support structure 21. The other rollers 27, 29 may be similarly mounted. Each roller 25 has an axle 34 supported in a pair of bearings 36 in a housing 35 which is itself secured relative to the panel 26. The attachment of the housing 36 relative to the panel 26 incorporates mounting means in the form of a rubber block 37, although other forms of mounting would be possible. The flexible mounting is desirable so as to accommodate tolerances in the height of the products, as will be apparent later in the description.

In operation, the bottles 11 are engaged by the carton blanks 50 prior to reaching the overhead boom arrangement 20. If the carton is to extend over the crown closure 51 of the bottles (OTC) in a one lane pack then the FIG. 3 configuration is used. Here the central belt 23 is moved so as to engage the top panel of the carton on top of the closures 51. As the belt 23 is being driven at machine speed, that is the speed the bottles are being driven at, the top portion of the bottles are securely held as the carton blank 50 is folded and secured about them. The flexible mounting means associated with the rollers ensures that the overhead boom can accommodate small variations in bottle height by upward deflection of the belts.

In a two lane OTC arrangement as shown in FIG. 4, the two fixed belts 22 engage the top panel of the blank 50 above the closures 51 and the central belt 23 is moved so as to be at the same height so as to engage the top panel of the blank 50 between the closures 51.

In FIG. 5, however, there is shown a two lane arrangement for cartons in which the bottle necks 52 extend through apertures in the blank which then rests on the shoulders 53 of the bottles. This type of package is known as a neck through (N/T) package. With the N/T package the fixed belts 22 engage the closures 51 of the two bottles whilst the central belt 23 is moved downwards relative to the two fixed belts 22. The central belt can then engage that part of the top panel of the blank 50 between the necks 52 of the bottles.

In FIG. 10, there is shown a further, more complex arrangement in which there are three fixed belts 22 and two movable belts 23. This arrangement is ideally suited to three lanes of bottles, the operation of which is readily apparent from the drawings.

It will be appreciated that other arrangements are possible in which more or even all belts are height adjustable relative to the support structure. It is also possible that the lateral position of the belts could also be made adjustable with reasonably simple modification.

Other adaptations will be apparent and may be necessary for different types of product and carton.

What is claimed is:

1. An overhead boom arrangement for use in a packaging machine comprising an adjustable support structure, a plurality of endless belts carried on and movable with said support structure, each endless belt being driven around a set of rollers mounted on the support structure and having an active portion of its path during which each of said belts engages products as the products move through the packaging machine, at least one of said belts being vertically adjustable relative to other belts carried on said support structure, such that said active portion of said path of said one belt is selectively vertically movable in a substantially parallel manner upwards and downwards relative to said support structure and said other belts carried on said support structure, and wherein said active portions of said belts extend parallel to each other and in use run at a speed approximately equal to the products moving through the packaging machine.

2. An overhead boom arrangement as claimed in claim 1 wherein three belts are provided, including a central belt that is vertically adjustable relative to said support structure of the boom arrangement, and two outer belts that are fixed relative to the support structure.

3. An overhead boom arrangement as claimed in claim 1 wherein five belts are provided, including central and extreme side belts fixed relative to the support structure, and belts positioned between the central belt and the respective extreme side belts, each of which is vertically adjustable relative to the support structure.

4. An overhead boom arrangement as claimed in claim 1 wherein in use, the complete overhead boom arrangement is movable vertically relative to the horizontal plane of the packaging machine.

5. An overhead boom arrangement as claimed in claim 1 wherein said belts are elastic.

6. An overhead boom arrangement as claimed in claim 1 wherein the belts are substantially circular in cross-section.

7. An overhead boom arrangement as claimed in claim 1 and wherein the endless belts are laterally adjustable.

8. An overhead boom arrangement as claimed in claim 1 wherein each belt is supported by rollers along said active portion of the path of each belt.

9. An overhead boom arrangement as claimed in claim 8 wherein the rollers of each belt are carried by a bracket which is vertically movable relative to said support structure of the boom arrangement.

10. An overhead boom arrangement as claimed in claim 9 wherein movement of said bracket is effected by a hand operated wheel attached to a sleeve carrying a threaded collar and mounted to said support structure, and a threaded shaft which cooperates with the threaded collar and which carries the bracket.

11. An overhead boom arrangement as claimed in claim 10 wherein the threaded shaft is movable along its lengthwise axis.

12. An overhead boom arrangement as claimed in claim 8 wherein the roller supporting each endless belt along said active portions are provided with resilient suspension means in a direction perpendicular to said active portions.

13. An overhead boom arrangement as claimed in claim 12 wherein the rollers are mounted on rubber mountings.

14. The overhead boom arrangement as claimed in claim 1, wherein at least one of said belts or at least one of said other belts engages top panels of carton blanks as the carton blanks are folded and secured about the products.

15. An overhead boom arrangement for use in a packaging machine comprising a moveable support structure, a bracket vertically adjustable with respect to said support structure, a plurality of endless belts carried on said support structure, each endless belt being driven around a set of rollers mounted on the support structure and having an active portion of its path during which each of said belts engages a series of products as the products move through the packaging machine, at least one of said belts being carried on said bracket so as to be vertically adjustable relative to said support structure and other belts, carried on said support structure, which other belts are substantially vertically fixed with respect to said one belt, such that said active portion of said path of said one belt is movable upwards and downwards relative to said support structure, and wherein said active portions of said belts extend parallel to each other and in use run at a speed approximately equal to the products moving through the packaging machine.

16. The overhead boom arrangement as claimed in claim 15 wherein said one belt carried on said bracket is movable upwardly and downwardly substantially parallel to said support structure.

17. The overhead boom arrangement of claim 15 and wherein said rollers are flexibly mounted within said support structure to enable said belts to be deflected to accommodate variations in the products passing thereunder.

18. The overhead boom arrangement of claim 17 and further including at least one housing in which said rollers are mounted, and which is flexibly mounted within said housing.

* * * * *